US005988799A

United States Patent [19]

Abe et al.

[11] Patent Number: 5,988,799

[45] Date of Patent: Nov. 23, 1999

[54] INK-JET HEAD HAVING INK CHAMBER AND NON-INK CHAMBER DIVIDED BY STRUCTURAL ELEMENT SUBJECTED TO FRECKLING DEFORMATION

[75] Inventors: Shingo Abe, Tenri; Tetsuya Inui, Nara; Hirotsugu Matoba, Sakurai; Susumu Hirata, Ikoma-gun; Masaharu Kimura, Daito; Yorishige Ishii, Yamatotakada; Hajime Horinaka, Kashiba; Hiroshi Onda, Yamatokoriyama, all of Japan

[73] Assignee: Sharp Kabushiki Kaisha, Osaka, Japan

[21] Appl. No.: 08/711,295

[22] Filed: Sep. 6, 1996

[30] Foreign Application Priority Data

Sep. 25, 1995 [JP] Japan ..... 7-245966

[51] Int. Cl.[6] ..... B41J 2/045

[52] U.S. Cl. ..... 347/68; 347/54

[58] Field of Search ..... 347/54, 68, 70–72, 347/94; 310/330, 332

[56] References Cited

U.S. PATENT DOCUMENTS

| | | | |
|---|---|---|---|
| 4,072,959 | 2/1978 | Elmqvist | 347/68 |
| 4,383,264 | 5/1983 | Lewis | 347/68 |
| 4,533,082 | 8/1985 | Maehara et al. | 347/68 |
| 4,539,575 | 9/1985 | Nilsson | 347/68 |
| 4,584,590 | 4/1986 | Fischbeck et al. | 347/69 |
| 4,641,153 | 2/1987 | Cruz-Uribe | 347/68 |
| 4,825,227 | 4/1989 | Fischbeck et al. | 347/69 |
| 4,998,120 | 3/1991 | Koto et al. | 347/68 |
| 5,255,016 | 10/1993 | Usui et al. | 347/71 |
| 5,534,900 | 7/1996 | Ohno et al. | 347/54 |
| 5,666,141 | 9/1997 | Matoba et al. | 347/54 |
| 5,812,163 | 9/1998 | Wong | 347/68 |

FOREIGN PATENT DOCUMENTS

| | | | |
|---|---|---|---|
| 0128456 | 12/1984 | European Pat. Off. . | |
| 2166927 | 12/1976 | Germany . | |
| 4429904 A1 | 3/1995 | Germany . | |
| 19623620 A1 | 12/1996 | Germany . | |
| 60-38163 | 2/1985 | Japan | 347/68 |
| 60-68963 | 4/1985 | Japan . | |
| 63-297052 | 12/1988 | Japan . | |
| 64-9745 | 1/1989 | Japan . | |
| 2-30543 | 1/1990 | Japan . | |
| 3-108551 | 5/1991 | Japan . | |
| 3-243357 | 10/1991 | Japan | 347/68 |
| 4-28557 | 1/1992 | Japan . | |
| 4-353458 | 12/1992 | Japan | 347/54 |

*Primary Examiner*—John E. Barlow, Jr.
*Assistant Examiner*—C. Dickens
*Attorney, Agent, or Firm*—Nixon & Vanderhye P.C.

[57] ABSTRACT

An ink-jet head is provided with a container having an ink-discharge opening in its wall section; a structural element that has peripheral edges at least both ends in one direction of which are secured to the wall faces inside the container, that divides the inside of the container in a fluid-separated state, and that is allowed to be distorted; and a voltage-applying unit for applying a voltage to the structural element. The structural element is constituted of a piezoelectric material, and the shape of the structural element is changed in response to the voltage applied by the voltage-applying unit so that ink is allowed to discharge from the ink-discharge opening. Therefore, the above-mentioned arrangement makes it possible to provide a greater ink-discharging force and ink-discharging speed, while maintaining a small size of the head. Moreover, it is possible to provide an ink-jet head having a good discharging efficiency with long service life.

17 Claims, 12 Drawing Sheets

14
18
14

14
19a
18
14

14
11
19a
18
14

19b
11
19a
14
18
14

19b
11
19a
14
18
14

19b
11
19a
14
18
18a
14

19b
11
19a
15
13
18
18a

INK-JET HEAD HAVING INK CHAMBER AND NON-INK CHAMBER DIVIDED BY STRUCTURAL ELEMENT SUBJECTED TO FRECKLING DEFORMATION

FIELD OF THE INVENTION

The present invention relates to an ink-jet head for carrying out a recording operation by applying pressure to ink that is filled inside a container so as to allow the ink to be emitted and sprayed from the container, and also concerns a manufacturing method thereof.

BACKGROUND OF THE INVENTION

Conventionally, an ink-jet recording method, which carries out a recording operation by emitting and spraying recording fluid, has been known. The ink-jet recording method has achieved various advantages: relatively high-speed printing can be carried out with low noise, the apparatus can be miniaturized, a color recording process is easily carried out, etc.

With respect to ink-jet heads used in the ink-jet recording method, several arrangements have been conventionally proposed. For example, one of such ink-jet heads has an arrangement wherein pressure is applied to the ink indirectly through a diaphragm by subjecting a piezoelectric element to an in-plane deformation resulting in ink emission.

However, the following problems have been presented from the above-mentioned conventional arrangement. In the above-mentioned ink-jet head, the piezoelectric element is subjected to an in-plane deformation in order to obtain sufficient pressure to emit the ink. In this case, in order to emit the ink, the amount of distortion of the piezoelectric element has to be increased by, for example, stacking piezoelectric materials or providing a bimorph-type piezoelectric actuator with a comparatively large dimension. One of the resulting problems is that a piezoelectric element and a pressure chamber, which are far greater in size than the nozzle pitch, are required, making the ink-jet head become bulky as well as making it difficult to form a multi-nozzle head wherein nozzles are integrated. The other problem is that since the pressure is indirectly applied to the ink by vibrating the diaphragm using the piezoelectric element, it is difficult to effectively convert mechanical energy generated by the piezoelectric element into discharging energy of the ink droplets.

SUMMARY OF THE INVENTION

It is an objective of the present invention to provide an ink-jet head which furnishes a great ink-discharging force and discharging speed while keeping its compact size, and a manufacturing method thereof.

In order to achieve the above-mentioned objective, the ink-jet head of the present invention is provided with a container having an ink-discharge opening in its wall section, a structural element in which at least two opposite ends in one direction of the peripheral edges are secured to the wall faces inside the container, which divides the inside of the container in a fluid-sealed state, and which is allowed to be distorted, and a voltage-applying device for applying a voltage to the structural element. Here, the structural element is constituted of a piezoelectric material, and the shape of the structural element is changed in response to the voltage applied by the voltage-applying device so that ink is allowed to discharge from the ink-discharge opening.

With this arrangement, the structural element consisting of the piezoelectric material divides the inside of the container in a fluid-sealed state. Therefore, when the structural element is distorted in response to the voltage applied by the voltage-applying device, the ink, contained inside the container, is directly pressurized by the structural element. Thus, different from conventional arrangements, it is possible to easily discharge the ink without using stacked piezoelectric materials or without providing a bimorph-type piezoelectric actuator which has a comparatively large dimension. Therefore, the above-mentioned arrangement makes it possible to positively discharge the ink while maintaining the small dimension of the ink-jet head. Further, since the ink inside the container is directly pressurized by the structural element, it is possible to effectively convert mechanical energy that has been generated by the structural element into discharging energy of the ink droplets.

Moreover, since the structural element divides the inside of the container in a fluid-sealed state, the ink, contained in the container, is prevented from leaking into other spaces. Therefore, the above-mentioned arrangement makes it possible to provide greater ink-discharging force and ink-discharging speed in response to the distortion of the above-mentioned structural element.

Furthermore, when the above-mentioned structural element is designed to have a plurality of layers and when electrodes, which apply voltages to the above-mentioned structural element, are installed on each layer in a manner so as to sandwich the layer, the distance between the electrodes in each layer can be shortened. Thus, even if the voltage to be applied to each layer is reduced, it is possible to distort the structural element sufficiently, and consequently to reduce the power consumption.

In particular, when the above-mentioned structural element is designed to have an elliptical shape, the stress that is imposed on the structural element upon distortion thereof is prevented from concentrating on a particular portion. Therefore, this arrangement makes it possible to reduce fatigue of the above-mentioned structural element, and consequently to provide an ink-jet head with long service life.

In order to achieve the above-mentioned objective, the manufacturing method of the ink-jet head of the present invention has the following steps: forming a structural element as a film on a substrate, applying a temperature change until the tensile stress of the structural element has exceed its elastic limit, and etching the substrate in a state where an internal compressive stress still exists in the above-mentioned structural element.

With this method, the structural element is formed on the substrate as a film. Then, a temperature change is applied until the tensile stress of the structural element has exceeded its elastic limit. In this case, when the substrate is etched in a state where an internal compressive stress still exists in the above-mentioned structural element, the structural element is deformed so as to release the internal compressive stress. Thus, the above-mentioned method makes it possible to easily provide the structural element which has been preliminarily deformed.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a cross-sectional view showing a state wherein a buckling structural element has not been subjected to a buckling deformation in the ink-jet head; and FIG. 1(*c*) is a cross-sectional view showing a state wherein the buckling structural element has been subjected to a buckling deformation toward the pressure-chamber side in the ink-jet head.

FIG. 7(*b*) is a cross-sectional view showing a state wherein a buckling structural element has not been subjected to a buckling deformation in the ink-jet head; and FIG. 7(*c*) is a cross-sectional view showing a state wherein the buckling structural element has been subjected to a buckling deformation toward the pressure-chamber side in the ink-jet head.

FIG. 8(*b*) is a cross-sectional view showing a state wherein the buckling structural element has been subjected to a buckling deformation toward the side opposite to the pressure-chamber side in the ink-jet head; and FIG. 8(*c*) is a cross-sectional view showing a state wherein a buckling structural element has not been subjected to a buckling deformation in the ink-jet head.

FIG. 12(*b*) is a cross-sectional view showing a state wherein the buckling structural element has not been subjected to a buckling deformation in the ink-jet head; and FIG. 12(*c*) is a cross-sectional view showing a state wherein the buckling structural element has been subjected to a buckling deformation toward the pressure-chamber side in the ink-jet head.

FIG. 13(*b*) is a cross-sectional view showing a state wherein the buckling structural element has not been subjected to a buckling deformation in the ink-jet head; and FIG. 13(*c*) is a cross-sectional view showing a state wherein the buckling structural element has been subjected to a buckling deformation toward the pressure-chamber side in the ink-jet head.

FIG. 14(*b*) is a cross-sectional view showing a state wherein the buckling structural element has not been subjected to a buckling deformation in the ink-jet head; and FIG. 14(*c*) is a cross-sectional view showing a state wherein the buckling structural element has been subjected to a buckling deformation toward the pressure-chamber side in the ink-jet head.

DETAILED DESCRIPTION OF THE PREFERRED EMBODIMENTS

Embodiment 1

Figure 1:
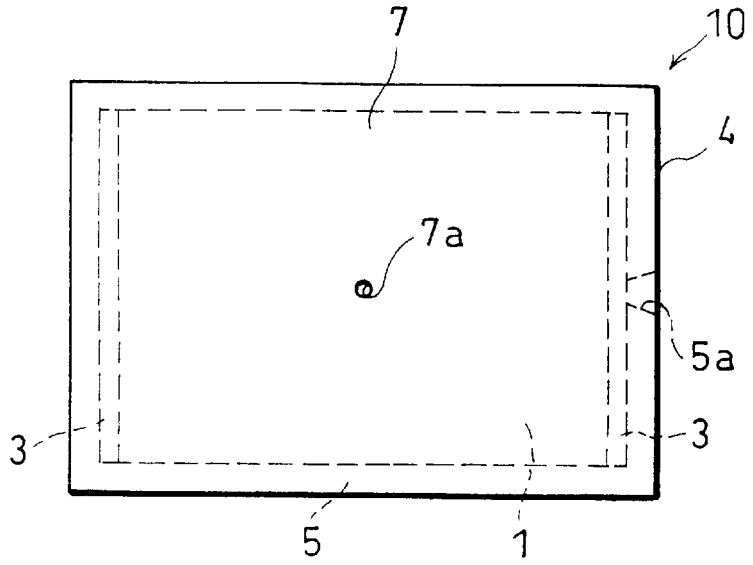
FIG. 1(*a*) is a plan view showing a schematic construction of an ink-jet head of the present invention.
Figure 1:
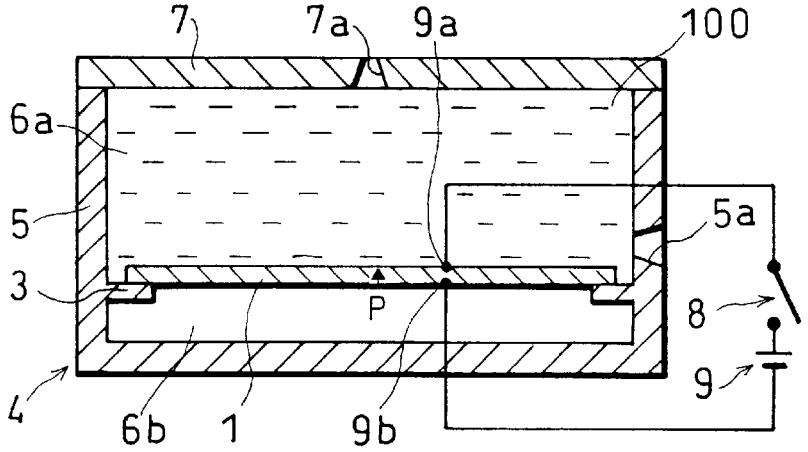
Figure 1:
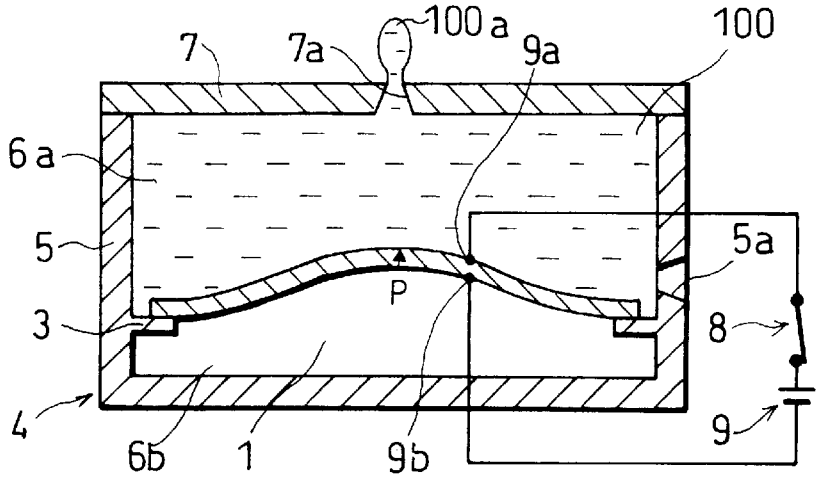

Referring to FIGS. 1(*a*) through 1(*c*), the following description will discuss one embodiment of the present invention.

FIG. 1(*a*) is a plan view of an ink-jet head 10 of the present embodiment. FIGS. 1(*b*) and 1(*c*) are cross-sectional views of the ink-jet head 10. The ink-jet head 10 of the present embodiment is constituted of a buckling structural element 1 (structural element), a container 4, electrodes 9*a* and 9*b* for applying a voltage to the buckling structural element 1, fixing members 3 that are used for fixedly securing the buckling structural element 1 to the container 4, a switch 8, and an external power source 9 (voltage-applying means).

The container 4 is constituted of a box-shaped body 5 having an ink inlet 5*a* and a nozzle plate 7 that covers the upper surface of the box-shaped body 5 and that has an ink-discharge opening 7*a*. The ink-discharge opening 7*a* has a tapered shape, that is, is narrowed outward to its top.

The buckling structural element 1 is made of a piezoelectric material such as, for example, PZT (solid solution of $PbZnO_3$ and $PbTiO_3$). Further, the buckling structural element 1 has a rectangular plate shape so that it divides the inside of the container 4 into a lower space 6*b* and a pressure chamber 6*a* in a fluid-sealed state. Moreover, among the peripheral edges of the face of the buckling structural element 1 that opposes the nozzle plate 7 inside the container 4, at least two opposite ends in one direction are secured to the fixing members 3. Thus, the buckling structural element 1 is subjected to buckling deformations in response to the load and unload of a voltage from the electrodes 9*a* and 9*b* that are installed in a manner so as to sandwich the buckling structural element 1. In the present embodiment, upon application of voltage from the power source 9, the buckling structural element 1 is subjected to a buckling deformation toward the pressure chamber 6*a* side so that ink droplets 100*a* are discharged from the ink-discharge opening 7*a*. Here, the load and unload of the voltage is carried out by the on-and off-operations of the switch 8, and the supply of voltage is carried out by the power source 9.

Referring to FIGS. 1(*a*) through 1(*c*), an explanation will be given of the operation of the ink-jet head of the present invention. First, ink 100 is injected and charged into the pressure chamber 6*a* through the ink inlet 5*a*. Next, the switch 8 is turned on so that a reverse bias voltage is applied from the power source 9 across the electrodes 9*a* and 9*b* on the respective ends of the buckling structural element 1 in the polarization direction P (+ on the upper side and – on the lower side) of the buckling structural element 1, as is shown in FIG. 1(*b*). Then, the buckling structural element 1 tries to expand in the in-plane direction by the piezoelectric effect.

However, since at least two opposite ends in one direction among the peripheral edges of the buckling structural element 1 are secured to the fixing members 3, the compressive force accumulates inside the buckling structural element 1. When the compressive force exceeds the buckling load of the buckling structural element 1 that is determined by its material, shape and dimension, the buckling structural element 1 is subjected to a buckling deformation to a great degree upward perpendicularly to the face, that is, toward the pressure chamber 6*a* side, as is shown in FIG. 1(*c*). The ink 100, contained inside the pressure chamber 6*a* that is divided in a fluid-sealed state, is pressurized by the buckling deformation of the buckling structural element 1. Thus, the ink 100 is discharged out of the ink-discharge opening 7*a* of the nozzle plate 7 as ink droplets 100*a*.

When the switch 8 is turned off so as to stop the application of voltage, the buckling structural element 1 contracts and returns to its original state, as is shown in FIG. 1(*b*). Such repeated on- and off-operations of the switch 8 allow the ink droplets 100*a* to be discharged, thereby enabling printing on a sheet of recording paper.

With this arrangement, the buckling structural element 1, whose peripheral edges are partially secured, produces a great amount of deformation in the out-of-plane direction, even if its amount of deformation in the in-plane direction is small. Therefore, it is possible to positively discharge ink droplets 100*a*, even when the dimension of the ink-jet head 10 is made small. Moreover, since the buckling structural element 1 also serves to keep the pressure chamber 6*a* in a sealed state, the ink 100 is prevented from leaking into the lower space 6*b*. Therefore, this arrangement furnishes a great ink-discharging force and discharging speed while keeping the compactness of the device. Furthermore, since the buckling structural element 1 directly pressurizes the ink 100, it is possible to effectively convert mechanical energy that has been generated by the buckling structural element 1 into discharging energy of the ink droplets 100*a*. Further, since a large-size piezoelectric material, required in conventional arrangements, is no longer required, it is possible to easily provide a multi-nozzle head having integrated nozzles.

Additionally, in the present embodiment, the ink-jet head 10 which is provided with the buckling structural element 1 having a rectangular plate shape has been exemplified; however, the shape of the buckling structural element 1 is not intended to be limited to the above-mentioned shape.

Embodiment 2

Figure 2:
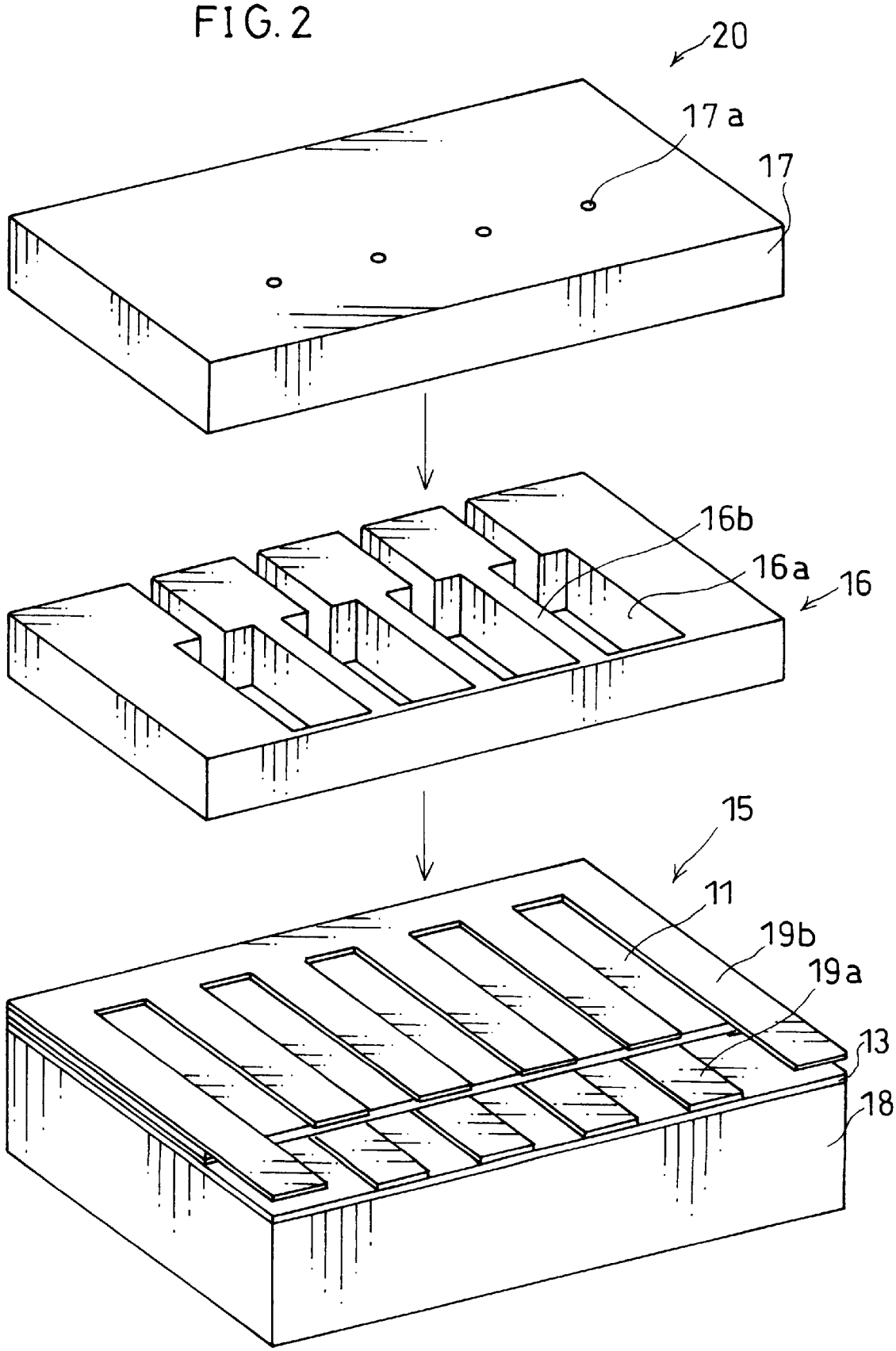
FIG. 2 is a perspective exploded view of an ink-jet head having a multi-head structure.
Figure 3:
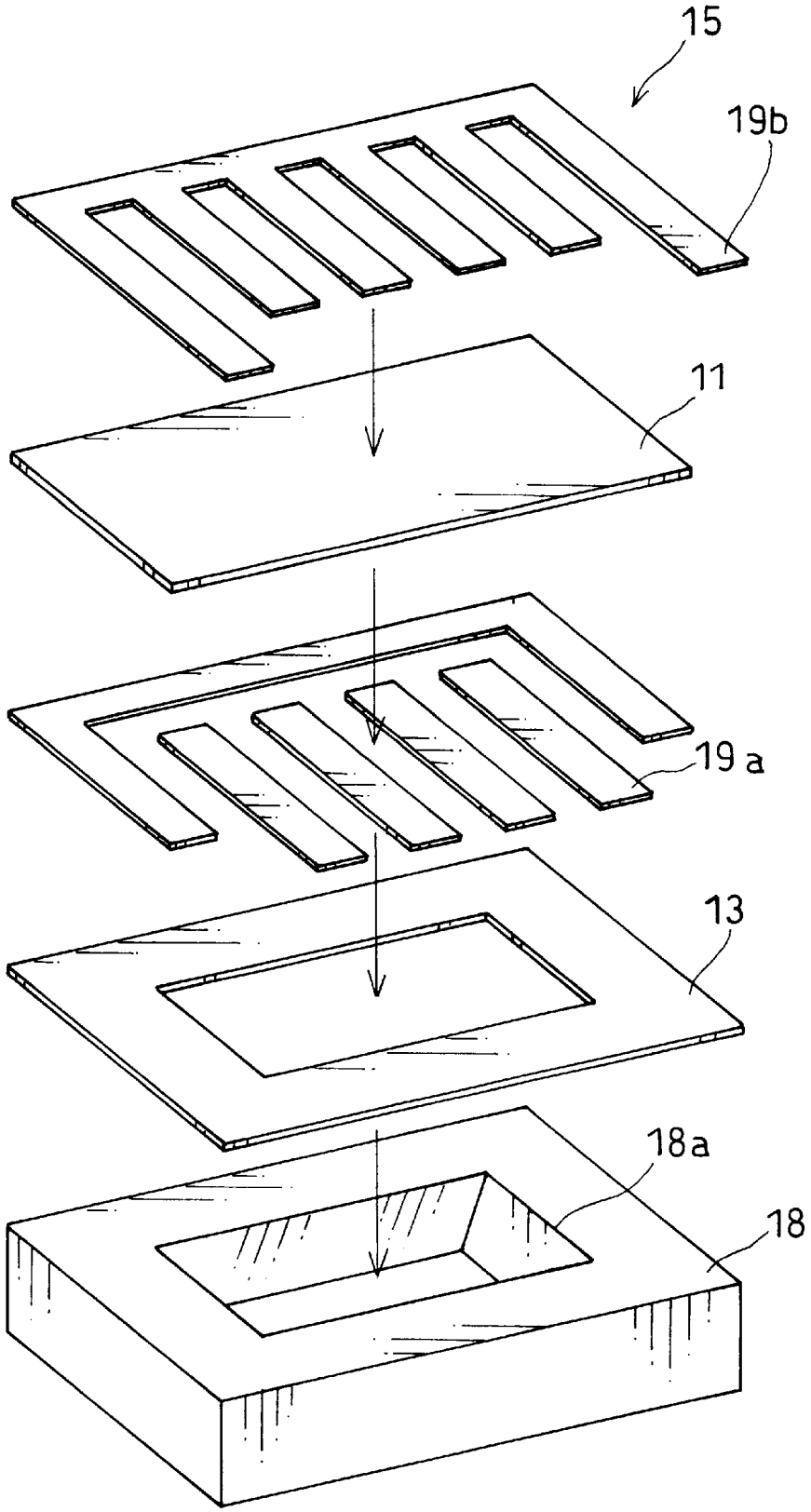
FIG. 3 is a perspective exploded view that shows a detailed structure of a box-shaped body in the ink-jet head.
Figure 4:
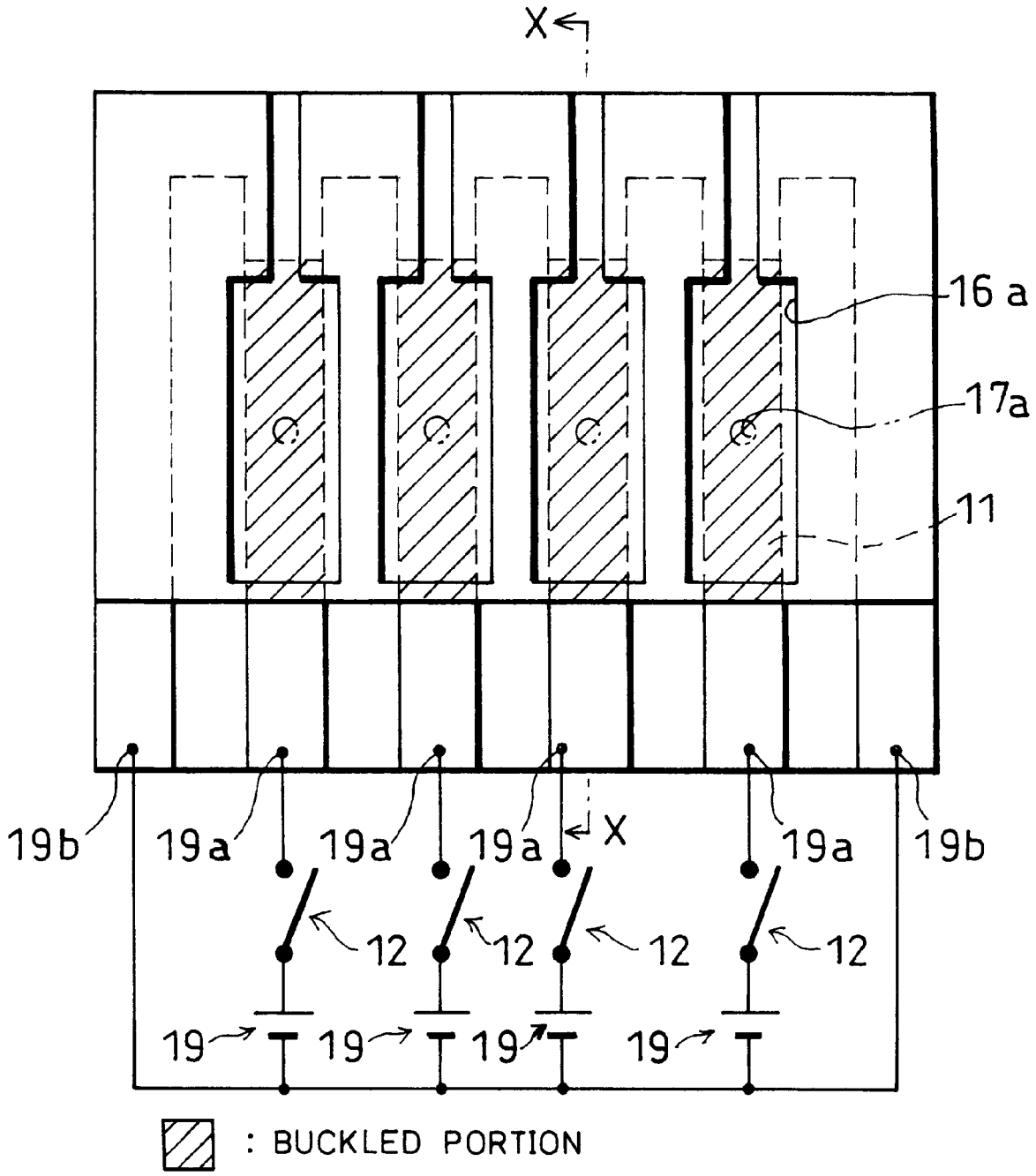
FIG. 4 is a plan view of the ink-jet head.
Figure 5:
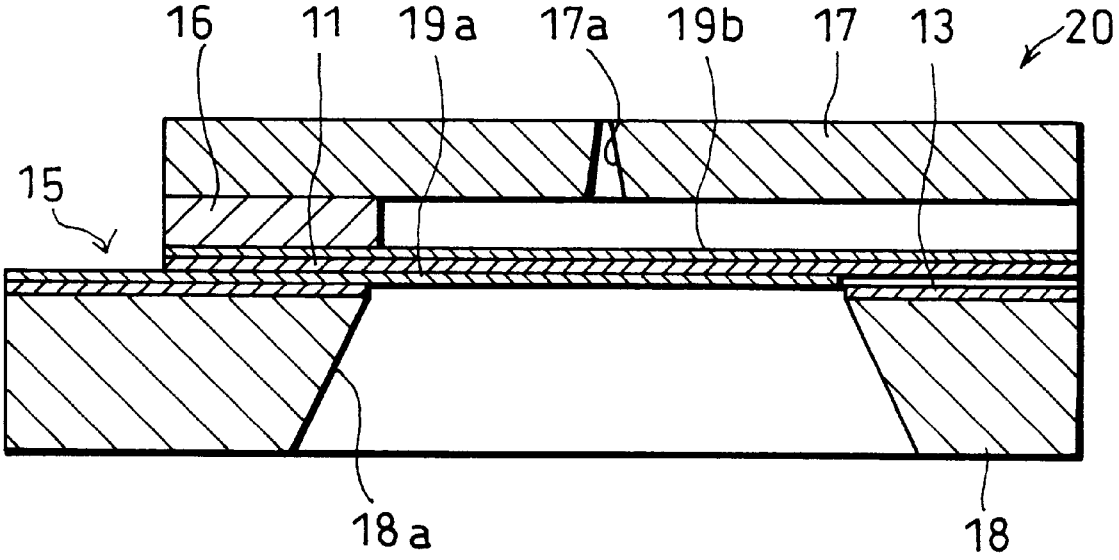
FIG. 5 is a cross-sectional view taken along line X—X in FIG. 4.

Referring to FIGS. 2 through 5, the following description will discuss an ink-jet head 20 wherein the ink-jet heads 10, described in Embodiment 1, are integrated. FIG. 2 is a perspective exploded view of the ink-jet head 20. FIG. 3 is a perspective exploded view that shows a detailed construction of a box-shaped body 15. FIG. 4 i s a plan view of the ink-jet head 20 of FIG. 2, and FIG. 5 is a cross-sectional view taken along line X—X in FIG. 4.

As illustrated in FIG. 2, the ink-jet head 20 is constituted of the box-shaped body 15 that forms lower spaces of the container, a spacer 16 that forms a plurality of pressure chambers (ink-storing chambers) in the upper section of the box-shaped body 15, and a nozzle plate 17 that has a plurality of ink-discharge openings 17*a* and that forms an upper section of the container. Thus, the ink-jet head 20 has a multi-head structure.

As illustrated in FIG. 3, the box-shaped body 15 is constituted of a substrate 18 that forms an essential part of the box-shaped body 15 and a buckling structural element 11 that is placed on the upper surface of the substrate 18 through fixing members 13. Further, a pair of electrodes 19*a* and 19*b* are respectively disposed in a manner so as to sandwich the buckling structural element 11.

The spacer 16, shown in FIG. 2, is made of a stainless copper plate having a thickness of, for example, 10 to 50 $\mu$m. Here, four openings 16*a*, each of which forms a pressure chamber and an ink inlet, are formed by stamping, and partition walls 16*b* separate the respective openings 16*a*. The peripheral edges of the buckling structural element 11 are secured by the partition walls 16*b* and the fixing members 13 (see FIG. 3).

The nozzle plate 17, which is made of glass material having a thickness of, for example, 0.2 mm, has four ink-discharge openings 17*a*, each of which is narrowed outward to the top, that is, has a conical shape or a funnel shape, as illustrated in FIG. 5. The ink-discharge opening 17*a* is formed by etching that uses hydrofluoric acid. The nozzle plate 17 is joined to the box-shaped body 15 by a non-conductive adhesive through the spacer 16.

The substrate 18 is made of, for example, a mono-crystal silicon substrate with a facial azimuth (100). As illustrated in FIG. 3, the substrate 18 is provided with a tapered hole section 18*a* that penetrates the substrate 18. The buckling structural element 11 is constituted of a piezoelectric material such as PZT. Further, the electrodes 19*a* and 19*b* are made of platinum (Pt) having electrical conductivity. As illustrated in FIG. 4, one of the electrodes 19*a* is connected to the positive terminal of each power source 19 through a switch 12, and one of the electrodes 19*b* is connected to the negative terminal of each power source 19. Thus, the on- and off-operations of the switch 12 carry out the application and stop of voltage.

Since the operation of the ink-jet head 20 is carried out in the same manner as Embodiment 1, the explanation thereof is omitted.

Figures 6A, 6B, 6C, 6D, 6E, 6F, 6G:
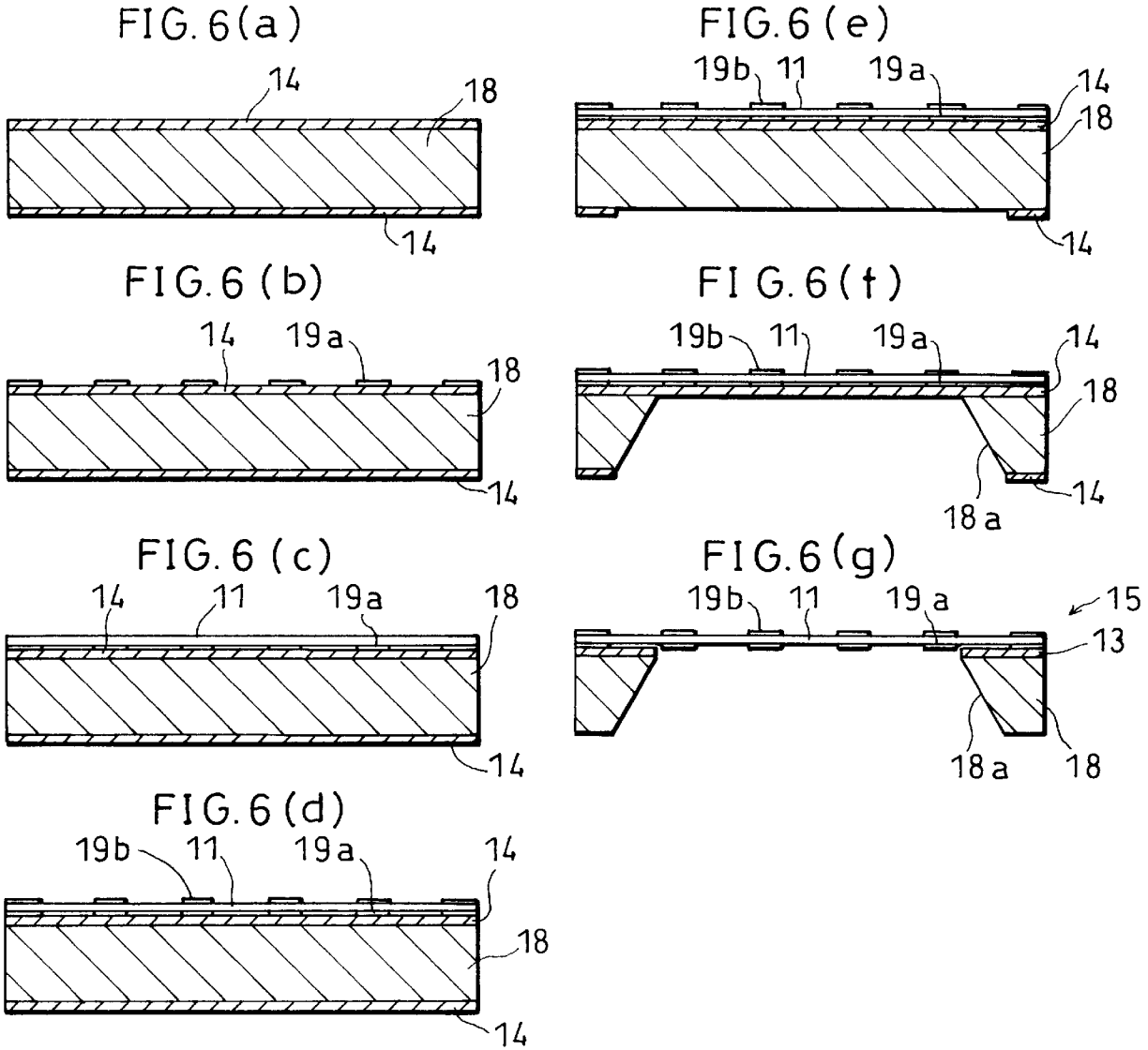
FIGS. 6(*a*) through 6(*g*) are cross-sectional views that show manufacturing processes of the box-shaped body of FIG. 3.

Referring to FIGS. 6(*a*) through 6(*g*), the following description will discuss manufacturing processes of the box-shaped body 15 that is installed in the ink-jet head 20.

First, as illustrated in FIG. 6(*a*), silicon oxide ($SiO_2$) layers 14, each of which has a thickness of 2 $\mu$m and contains phosphorus (P) of 6 to 8%, (hereinafter, referred to as PSG (Phospho-Silicate Glass) layers 14) are formed on the surface and rear-surface of the substrate 18 that is made of mono-crystal silicon with a facial azimuth (100), by using the LPCVD (Low Pressure Chemical Vapor Deposition) device.

Next, as illustrated in FIG. 6(*b*), an electrode 19*a*, which is made of Pt with a thickness of 0.2 $\mu$m, is formed as a film on the surface of the PSG layer 14, and subjected to a patterning process. Successively, as illustrated in FIG. 6(*c*), a buckling structural element 11, which is made of PZT with a thickness of 3 $\mu$m, is formed as a film on the electrode 19*a*.

Next, as illustrated in FIG. 6(*d*), an electrode 19*b*, which is made of Pt with a thickness of 0.2 $\mu$m, is formed as a film on the surface of the buckling structural element 11, and subjected to a patterning process. Successively, as illustrated in FIG. 6(*e*), the PSG layer 14 on the rear-surface of the substrate 18 is subjected to a patterning process. Then, as illustrated in FIG. 6(*f*), the silicon substrate 18 is subjected to an anisotropic etching process by using the patterned PSG layer 14 as a mask, so as to provide a tapered hole section 18*a* that penetrates the substrate 18.

Lastly, as illustrated in FIG. 6(*g*), the PSG layer 14 is etched by using the tapered hole section 18*a* of the etched substrate 18 as a mask. Thus, fixing members 13 are formed by the remaining PSG layers 14, and the box-shaped body 15 having a desired construction is obtained.

With this arrangement, the box-shaped body 15, the spacer 16 and the nozzle plate 17 are integrally formed, and a plurality of heads, which are individually controlled, are manufactured at the same time; therefore, it is possible to manufacture compact heads with low costs. Moreover, such a multi-head arrangement makes it possible to improve functions of the ink-jet head 20.

In the present embodiment, the four-head arrangement is exemplified for convenience of explanation; however, the number of heads is not intended to be limited to this number in the ink-jet head 20 of the present invention, and is desirably determined.

Embodiment 3

In the above-mentioned Embodiments 1 and 2, a reverse bias voltage is applied in the polarization direction of the buckling structural element 1 or 11. In these arrangements, the polarization direction is inverted if the applied voltage is too high. Consequently, the buckling structural element 1 or 11 is not allowed to expand in the in-plane direction, thereby failing to discharge ink. Here, in the present embodiment, an explanation will be given of an ink-jet head 30 which applies a forward bias voltage in the polarization direction of the buckling structural element 1 so as to discharge ink. For convenience of explanation, those members that have the same functions as those used in Embodiments 1 and 2 are indicated by the same reference numbers, and the description thereof is omitted.

Figure 7:
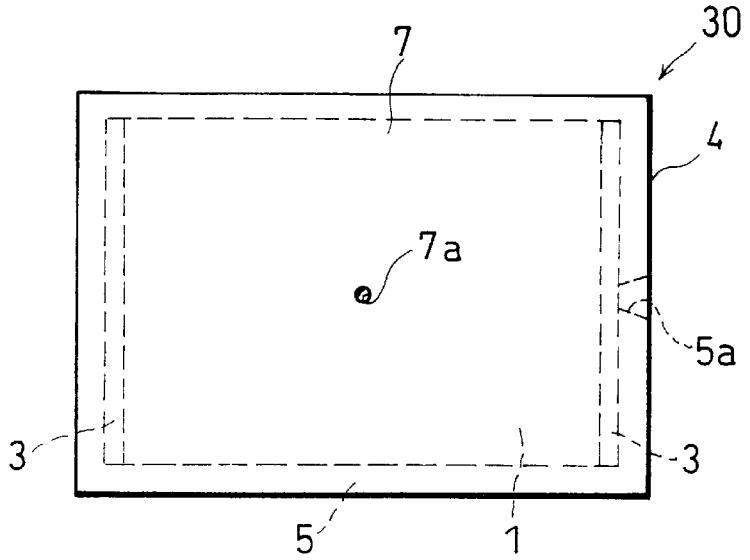
FIG. 7(*a*) is a plan view showing another construction of the ink-jet head of the present invention.
Figure 7:
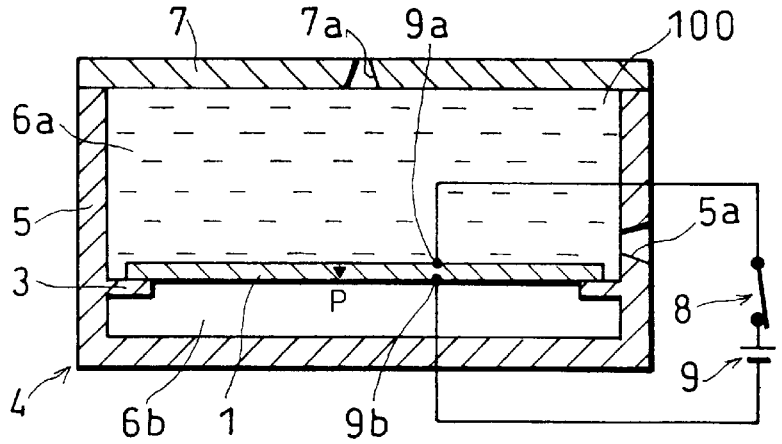
Figure 7:
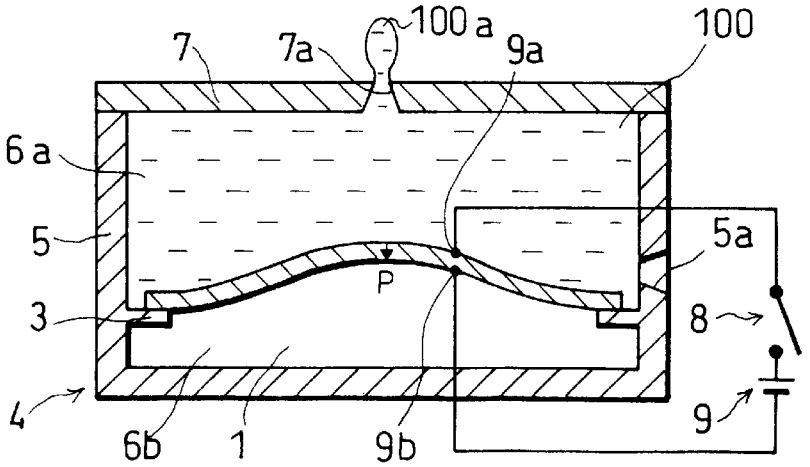

FIG. 7(*a*) is a plan view of the ink-jet head 30 of the present embodiment. FIGS. 7(*b*) and 7(*c*) are cross-sectional views of the ink-jet head 30. The present embodiment is different from the aforementioned Embodiment 1 in that a forward bias voltage is applied in the polarization direction P of the buckling structural element 1 and that upon no application of voltage, the buckling structural element 1 is subjected to a buckling deformation toward the pressure chamber 6*a* side. Then, the buckling structural element 1 is subjected to in-plane deformations in response to the load and unload of a voltage from the electrodes 9*a* and 9*b* that are installed in a manner so as to sandwich the buckling structural element 1. The other arrangements are the same as those of Embodiment 1.

The ink-jet head 30 of the present embodiment is driven as follows: First, as illustrated in FIG. 7(*b*), a forward bias voltage has been applied in the polarization direction P of the buckling structural element 1 (– on the upper side and + on the lower side) with the switch 8 on. In this case, the buckling structural element 1 tries to contract in the in-plane direction by the piezoelectric effect so that the buckling structural element 1, which has been subjected to a buckling deformation toward the pressure chamber 6*a* side, is held in a state where it is no longer subjected to the buckling deformation, as shown in FIG. 7(*b*).

Next, when the switch 8 is turned off, the contraction of the buckling structural element 1 in the in-plane direction is released, and the buckling structural element 1 returns to its original state. In other words, as illustrated in FIG. 7(*c*), the buckling structural element 1 is subjected to a buckling deformation to a great degree toward the pressure chamber 6*a* side. The buckling deformation pressurizes ink 100, which is contained in the pressure chamber 6*a* in a fluid-sealed state. Thus, the ink 100 is discharged out of the ink-discharge opening 7*a* of the nozzle plate 7 as ink droplets 100*a*.

With this arrangement, since a forward bias voltage is applied in the polarization direction of the buckling structural element 1, the polarization direction of the buckling structural element 1 is not inverted even if a comparatively high voltage is applied to the buckling structural element 1. Therefore, it is possible to apply a greater voltage, as compared with the case using a reverse bias voltage.

Embodiment 4

As in the above-mentioned Embodiment 3, an explanation will be given of an ink-jet head 40 which applies a forward bias voltage in the polarization direction of the buckling structural element 1 so as to discharge ink. For convenience of explanation, those members that have the same functions as those used in Embodiments 1 through 3 are indicated by the same reference numbers, and the description thereof is omitted.

Figure 8:
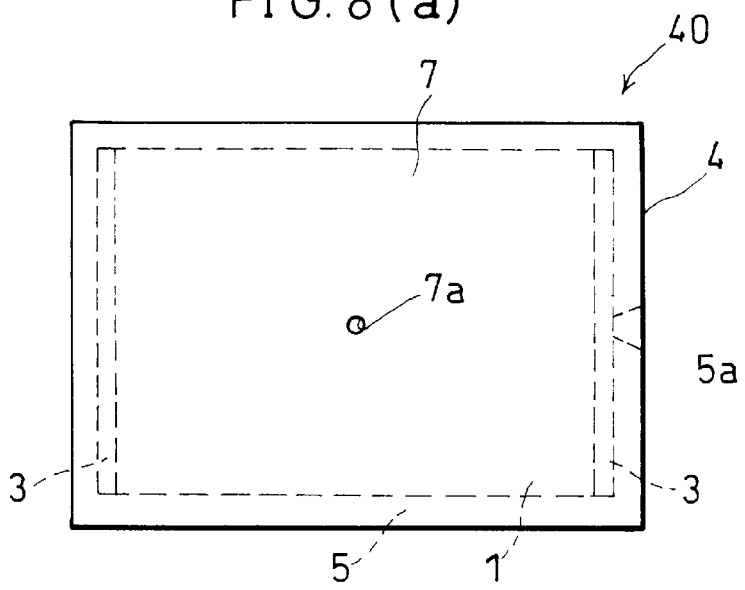
FIG. 8(*a*) is a plan view showing still another construction of the ink-jet head of the present invention.
Figure 8:
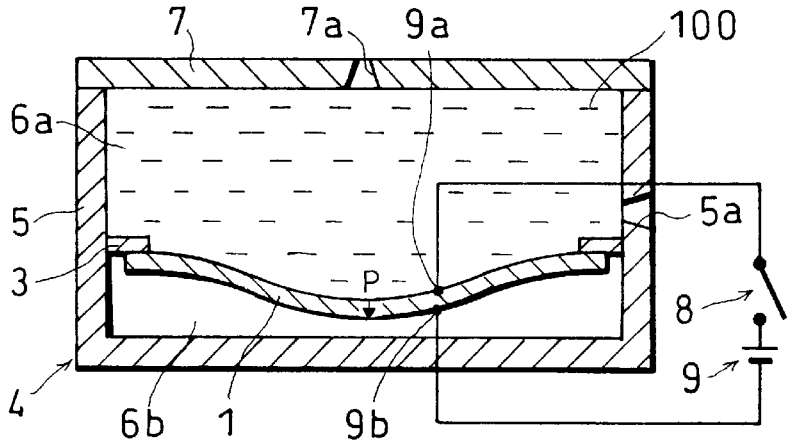
Figure 8:
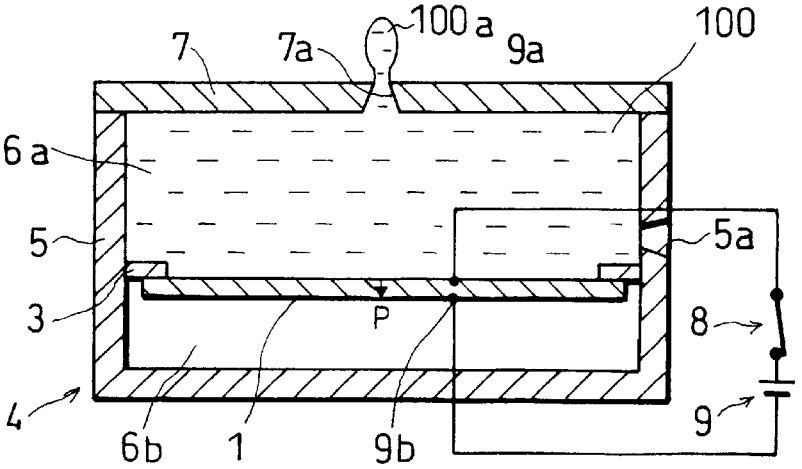

FIG. 8(*a*) is a plan view of the ink-jet head 40 of the present embodiment. FIGS. 8(*b*) and 8(*c*) are cross-sectional views of the ink-jet head 40. The ink-jet head 40 of the present embodiment is different from that of the aforementioned Embodiment 1 in that a forward bias voltage is applied in the polarization direction P of the buckling structural element 1 and that upon no application of voltage, the buckling structural element 1 is subjected to a buckling deformation toward the side opposite to the pressure chamber 6*a*. Then, the buckling structural element 1 is subjected to in-plane deformations in response to the load and unload of a voltage from the electrodes 9*a* and 9*b* that are installed in a manner so as to sandwich the buckling structural element 1. The other arrangements are the same as those of Embodiment 1.

The ink-jet head 40 of the present embodiment is driven as follows: First, as illustrated in FIG. 8(*b*), the buckling structural element 1 is designed to be subject to a buckling deformation toward the side opposite to the pressure chamber 6*a* when the switch 8 is off. Next, when the switch 8 is turned on, the buckling structural element 1 contracts in the in-plane direction so that it comes into a state where it is free from the buckling deformation, as shown in FIG. 8(*c*). In other words, in the present embodiment, the ink 100, which is contained inside the pressure chamber 6*a* in a fluid-sealed state, is pressurized by the positional change of the buckling structural element 1 from the buckled state (deformed state) to the non-buckled state (non-deformed state). Thus, the ink 100 is discharged out of the ink-discharge opening 7*a* of the nozzle plate 7 as ink droplets 100*a*.

With this arrangement, since a forward bias voltage is applied in the polarization direction P of the buckling structural element 1, the polarization direction of the buckling structural element 1 is not inverted even if a comparatively high voltage is applied to the buckling structural element 1. Therefore, it is possible to apply a greater voltage, as compared with the case using a reverse bias voltage.

Figure 9:
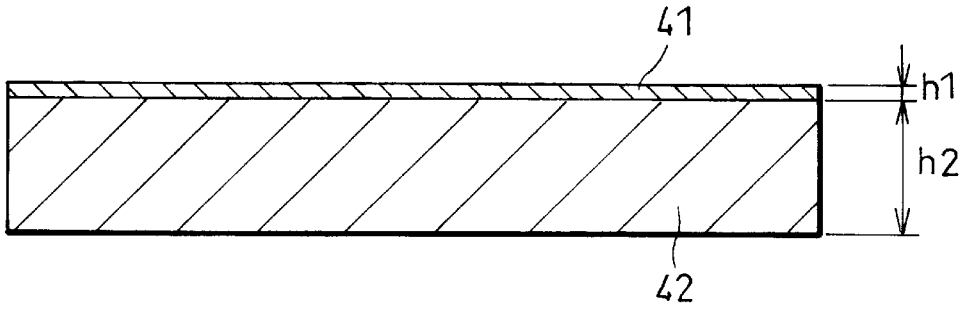
FIG. 9 is a cross-sectional view of a substrate and the buckling structural element that is formed on the substrate.
Figure 10:
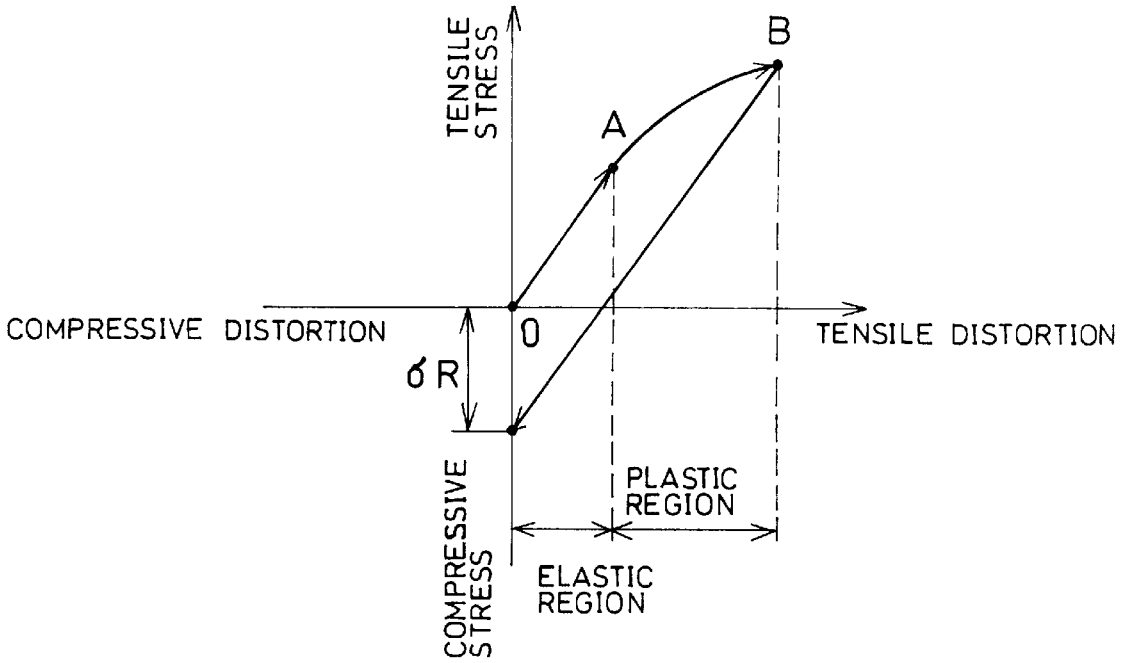
FIG. 10 is a graph which indicates a stress-distortion hysteresis curve in the buckling structural element that has been subjected to heat history.
Figure 11:
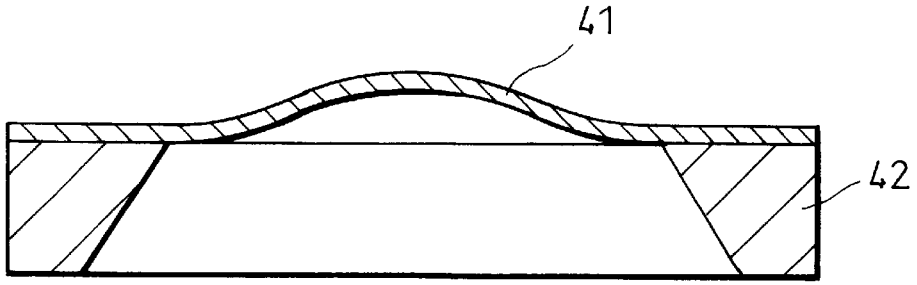
FIG. 11 is a cross-sectional view of the buckling structural element that has been subjected to the buckling deformation.

Referring to FIGS. 9 through 11, the following description will discuss a manufacturing method of the above-mentioned buckling structural element which comes into a buckling deformed state upon no application of voltage.

First, as illustrated in FIG. 9, a buckling structural element 41 with a thickness of h1 is formed as a film on a substrate 42 with a thickness of h2. In this case, the buckling structural element 41 needs to be substantially thinner than the substrate 42. In other words, $h1 \ll h2$ needs to be satisfied. Here, it is supposed that the linear expansion coefficient $\alpha 1$ of the buckling structural element 41 is different from the linear expansion coefficient $\alpha 2$ of the substrate 42.

When the substrate 42 is subjected to heat history, the buckling structural element 41 varies as indicated by a stress-distortion hysteresis curve in FIG. 10, and comes into a state wherein an internal compressive stress is generated. Here, two methods of heat treatment are proposed depending on the magnitudes of the linear expansion coefficients $\alpha 1$ and $\alpha 2$ of the buckling structural element 41 and the substrate 42. Hereafter, manufacturing methods of the buckling structural element 41 and principles thereof will be discussed in accordance with the respective methods of heat treatment.

(1) In this case, it is supposed that the linear expansion coefficient al of the buckling structural element 41 is smaller than the linear expansion coefficient $\alpha 2$ of the substrate 42.

Under this condition, the temperature is increased until the tensile stress occurring in the buckling structural element 41 exceeds its elastic limit, and then the temperature is returned to room temperature. Referring to FIG. 10, this method is explained in detail.

In a pre-application state of temperature change, the buckling structural element 41 is set at point O, that is, set in a non-distorted and non-stress state. Then, as the temperature rises, both the substrate 42 and the buckling structural element 41 expand. However, since the substrate 42 has a greater linear expansion coefficient than the buckling structural element 41, the buckling structural element 41 is subjected to a tensile load from the substrate 42 with the result that it has a tensile distortion and a tensile stress. The relationship between the tensile distortion and the tensile stress is indicated by a virtually straight line up to point A. When the temperature is further increased, the tensile stress exceeds its elastic limit, and is curved to reach point B as shown in FIG. 10. Next, when the application of heat is stopped, the expansion of the substrate 42 stops, and tries to return to a non-distorted state. In this case, the buckling structural element 41 returns to the non-distorted state, following a straight line from point B in parallel with the straight line OA; therefore, an internal compressive stress $\sigma R$ is exerted as shown in FIG. 10.

(2) In this case, it is supposed that the linear expansion coefficient $\alpha 1$ of the buckling structural element 41 is greater than the linear expansion coefficient $\alpha 2$ of the substrate 42.

Under this condition, the temperature is decreased until the tensile stress occurring in the buckling structural element 41 exceeds its elastic limit, and then the temperature is returned to room temperature. With respect to stresses and distortions shown in FIG. 10, the same explanation can be made except that the increase and decrease of temperature are replaced with each other.

When the substrate 42 is etched as shown in FIG. 11 while the internal compressive stress still exists in the buckling structural element 41 after application of either of the above-mentioned heat treatments, the buckling structural element 41 tries to release the internal compressive stress with the result that it has a buckling deformation as shown in FIG. 11. Thus, the above-mentioned methods make it possible to easily provide a buckling structural element 41 which has been preliminarily subjected to a buckling deformation.

Embodiment 5

Figure 12A:
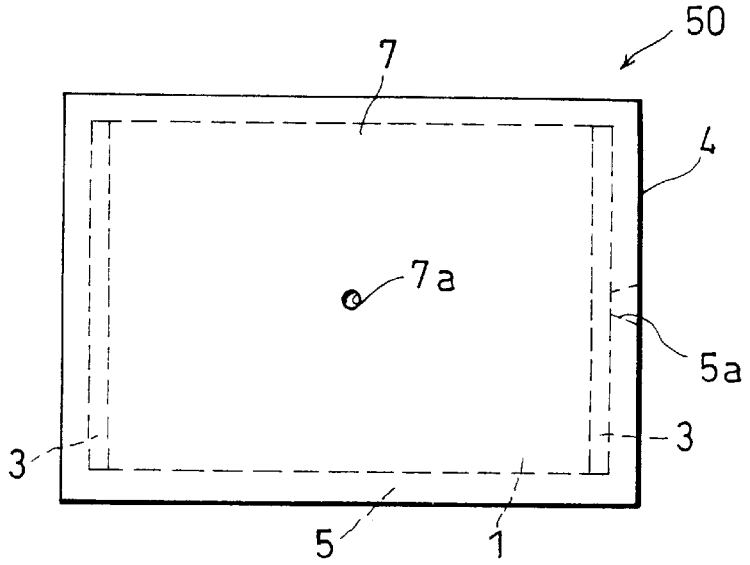
FIG. 12(*a*) is a plan view showing a construction of an ink-jet head having a buckling structural element of a stacked-layer construction.
Figure 12B:
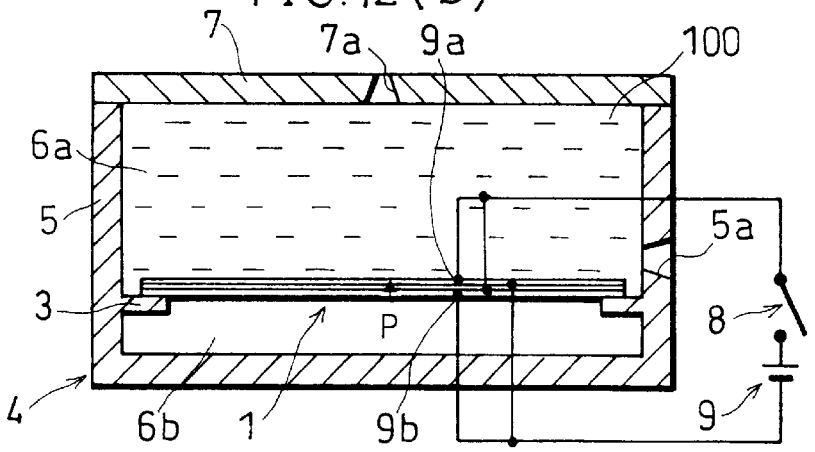
Figure 12C:
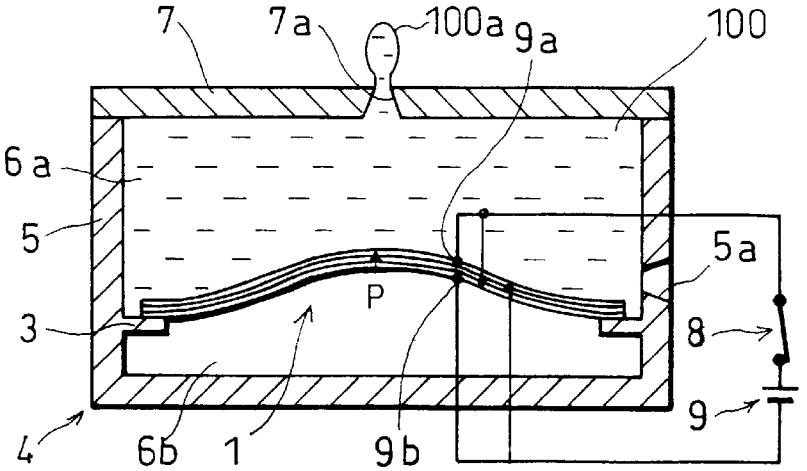

Referring to FIGS. 12(*a*) through 12(*c*), the following description will discuss still another embodiment of the present invention. Here, those members that have the same functions as the members used in Embodiments 1 through 4 are indicated by the same reference numbers, and its explanation is omitted.

FIG. 12(*a*) is a plan view of an ink-jet head 50 of the present invention. FIGS. 12(*b*) and 12(*c*) are cross-sectional views of the ink-jet head 50. A buckling structural element 1, which is installed in the ink-jet head 50 of the present embodiment, is constituted of a plurality of layers. A pair of electrodes 9*a* and 9*b* are attached to each layer in a manner so as to sandwich the layer; therefore, the distance between the electrodes 9*a* and 9*b* is shortened. Thus, the buckling structural element 1 is subjected to in-plane deformations in response to the load and unload of a voltage from the electrodes 9*a* and 9*b*. The other arrangements of this embodiment are the same as those of Embodiment 1. Moreover, the principle of driving is the same as that of Embodiment 1.

Here, supposing that the length of the piezoelectric material is 1, the amount of deformation of the piezoelectric material in the in-plane direction $\delta$ is represented by the following equation:

$$\delta = d_{31} \cdot V \cdot 1/h$$

where: $d_{31}$: piezoelectric constant,
V: voltage, and
h: thickness of the piezoelectric material.

The above-mentioned equation indicates that the shorter the thickness of the piezoelectric material, that is, the distance between the electrodes 9*a* and 9*b*, the smaller the voltage that is to be applied to deform the piezoelectric material. Therefore, it is possible to reduce the power consumption by designing the buckling structural element 1 using layers of a piezoelectric material, each provided as a thin layer, so that the distance between the electrodes 9*a* and 9*b* is shortened.

Additionally, the stacked-layer construction of the buckling structural element 1, used in the present embodiment, can also be applied to the aforementioned Embodiments 2 through 4. The same effects as the present embodiment are of course obtained by the application of this construction.

Embodiment 6

Figure 13A:
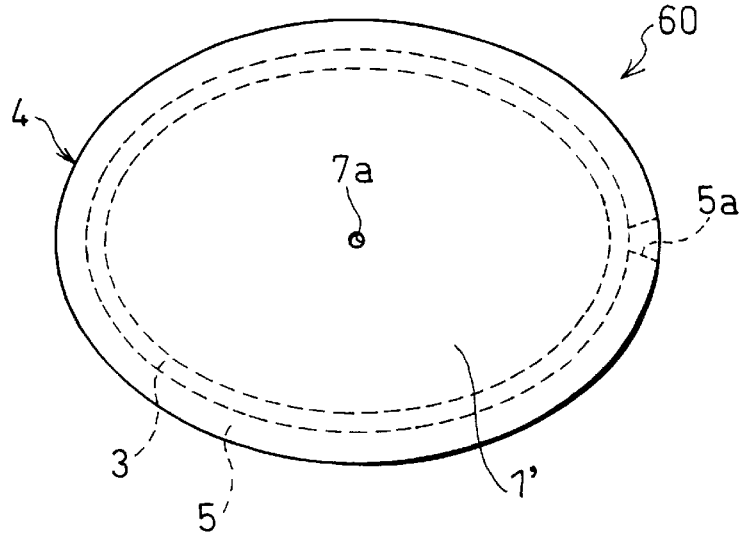
FIG. 13(*a*) is a plan view showing a construction of an ink-jet head having an elliptical buckling structural element.
Figure 13B:
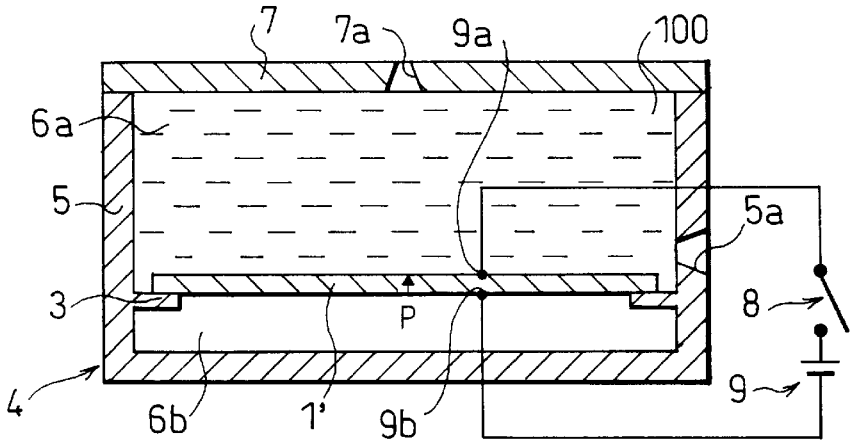
Figure 13C:
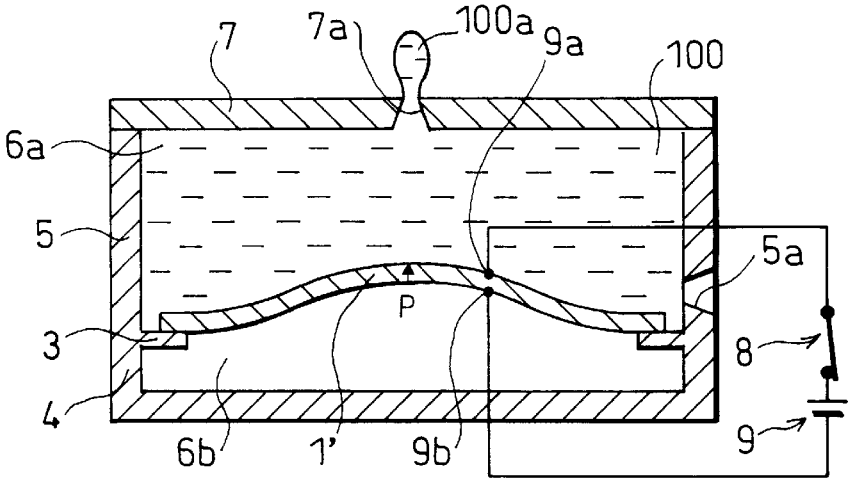
Figure 14A:
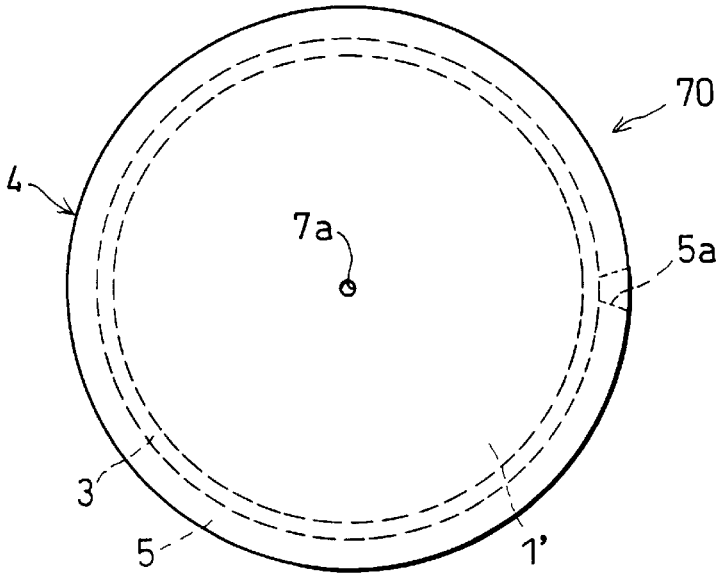
FIG. 14(*a*) is a plan view showing a construction of an ink-jet head having a round buckling structural element.
Figure 14B:
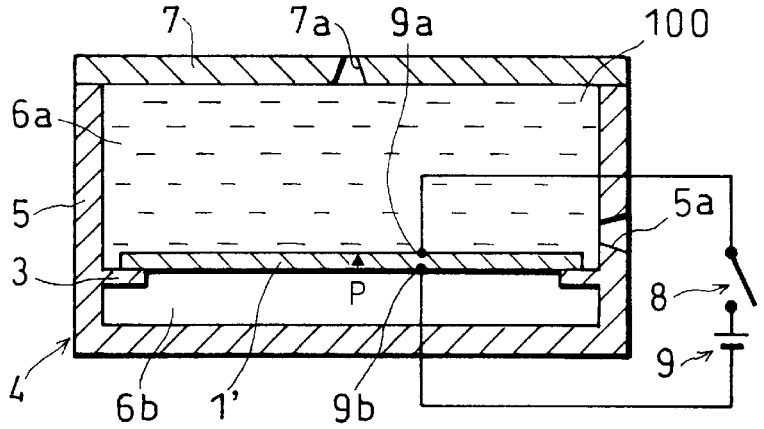
Figure 14C:
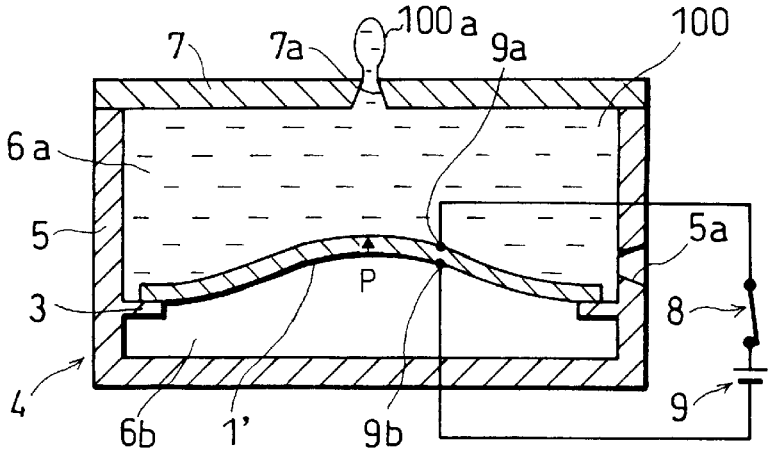

Referring to FIGS. 13(*a*) through 13(*c*) as well as to FIGS. 14(*a*) through 14(*c*), the following description will discuss still another embodiment of the present invention. Here, those members that have the same functions as the members used in Embodiments 1 through 5 are indicated by the same reference numbers, and its explanation is omitted.

FIG. 13(*a*) is a plan view of an ink-jet head 60 of the present embodiment. FIGS. 13(*b*) and 13(*c*) are cross-sectional views of the ink-jet head 60. A buckling structural element 1', which is installed in the ink-jet head 60 of the present embodiment, is designed to have an elliptical shape. The buckling structural element 1' is subjected to buckling deformations in response to the load and unload of a voltage from the electrodes 9*a* and 9*b* that are installed in a manner so as to sandwich the buckling structural element 1'. The other arrangements and the principle of driving are the same as those of Embodiment 1. Therefore, even if the buckling structural element 1' is formed into an elliptical shape, the same effects as those in Embodiment 1 can be obtained.

Further, in the case when the buckling structural element 1' having an elliptical shape is used, no corners are subjected to concentration of stress under buckled deformations, which is different from the buckling structural element 1 having a rectangular shape. Therefore, this arrangement makes it possible to reduce fatigue of the above-mentioned buckling structural element 1', and consequently to provide an ink-jet head with long service life. Furthermore, when comparisons are made between the buckling structural element 1' having an elliptical shape and the buckling structural element 1 having a rectangular shape, since concentration of stress in the vicinity of corners does not exist upon buckled deformations, the adoption of the buckling structural element 1' provides a greater discharging force and discharge speed under the same power consumption.

FIG. 14(*a*) is a plan view of an ink-jet head 70 which has a buckling structural element 1' whose shape is closer to an exact round shape than the buckling structural element 1'. FIGS. 14(*b*) and 14(*c*) are cross-sectional views of the ink-jet head 70. Here, since the principle of driving is the same as that of the aforementioned Embodiment, the description will be omitted.

As described above, if the buckling structural element 1' has a round shape, concentration of stress upon buckled deformations is positively eliminated. Therefore, in this case, the above-mentioned effects can be further increased. Thus, with respect to the shape of the buckling structural element 1', the round shape is the most suitable.

Additionally, the arrangement of round-shaped or elliptical-shaped buckling structural element 1' is applicable to Embodiments 2 through 5. These cases also provide the same effects as obtained in this embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink-jet head comprising:

a container having an ink-discharge opening and an ink-supplying inlet;

a structural element having a peripheral edge and oriented in an initial shape, the structural element being displaceable between a static plane non-deformed state and a buckling deformation deformed state, wherein at least opposite ends of the peripheral edge are secured inside the container, the structural element dividing the container into a sealed ink chamber containing ink and a non-ink chamber without containing ink, the sealed ink chamber including both the ink-discharge opening and the ink-supplying inlet; and a voltage-applying unit coupled with the structural element, the voltage-applying unit applying a voltage to the structural element, the structural element being formed of a piezoelectric material, and being expandable and contractable along the static plane and subjected to buckling deformation to affect a pressure in the ink chamber in response to the voltage applied by the voltage-applying unit so that ink is discharged from the ink-discharge opening, the opposite ends of the structural element being secured to the container such that the structural element is subjected to buckling deformation when a compressing force within the static plane of the structural element exceeds a buckling load.

2. The ink-jet head as defined in claim 1, wherein the structural element comprises an ink-discharge opening side facing the ink-discharge opening and an opposite side opposite from the ink-discharge opening side, the structural element having a polarization direction from the opposite side toward the ink discharge opening side such that upon application of the voltage from the voltage-applying unit, the structural element expands along the static plane to generate a compressive stress and is thereby subjected to the buckling deformation so that the ink is discharged from the ink-discharge opening.

3. The ink-jet head as defined in claim 1, wherein upon application of a predetermined voltage by the voltage-applying unit, the structural element contracts to a state without the buckling deformation, while upon termination of the application of the predetermined voltage by the voltage-applying unit, the contraction is removed with a result that the structural element is subjected to buckling deformation so that the ink is discharged from the ink-discharging opening.

4. The ink-jet head as defined in claim 1, wherein the structural element is subjected to a positional change from a deformed state to a non-deformed state in response to the voltage applied by the voltage-applying unit so that the ink is discharged from the ink-discharge opening.

5. The ink-jet head as defined in claim 1, wherien the structural element comprises a plurality of layers and a plurality of electrodes, which electrodes are installed in a manner so as to sandwich each of the layers in order to supply the voltage applied by the voltage-applying unit to each layer.

6. The ink-jet head as defined in claim 1, wherein the structural element is formed into an elliptical shape.

7. The ink-jet head as defined in claim 1, wherein the structural element is formed into a round shape.

8. The ink-jet head as defined in claim 1, wherein the structural element is polarized across a thickness direction thereof.

9. The ink-jet head as defined in claim 8, wherein the voltage-applying unit applies a predetermined voltage to the structural element in accordance with a polarizing direction of the structural element.

10. The ink-jet head as defined in claim 8, wherein the structural element is subjected to a buckling deformation when a voltage-applying unit applies a predetermined voltage that is reverse-biased with respect to a polarizing direction of the structural element so that the ink is discharged from the ink-discharge opening.

11. The ink-jet head as defined in claim 8, wherein upon application of a predetermined voltage that is forward-biased with respect to the polarizing direction of the structural element by the voltage-applying unit, the structural element contracts in in-plane directions to a state without a buckling deformation, while upon termination of the application of the predetermined voltage from the voltage-applying unit, the contraction is removed with a result that the structural element is subjected to a buckling deformation so that the ink is discharged from the ink-discharge opening.

12. The ink-jet head as defined in claim 8, wherein the case of no application of a predetermined voltage that is forward-biased with respect to the polarizing direction of the structural element by the voltage-applying unit, the structural element is subjected to a buckling deformation toward the non-ink chamber side, while upon the application of the predetermined voltage to the structural element, the structural element contracts the buckling-deformation state to a non-deformation state so that the ink is discharged from the ink-discharge opening.

13. The ink-jet head as defined in claim 1, wherein the voltage-applying unit applies to the structural element a voltage exceeding a buckling load of the structural element.

14. The ink-jet head as defined in claim 1, wherein the structural element is made of a single-layer piezoelectric material.

15. An ink-jet head-comprising:

box-shaped body that forms a plurality of first chambers containing ink and a plurality of second chambers without containing ink, each of the first chambers having an ink-discharge opening and an ink-supplying inlet and each of the second chambers being installed so as to correspond to each of the first chambers;

a plurality of structural elements each of which separates each of the first chambers and second chambers, respectively, each of the structural elements being oriented in an initial shape and displaceable between a static plane non-deformed state and a buckling deformation deformed state, each of the structural elements being further provided with two end portions that are secured to the box-shaped body; and a plurality of voltage-applying units coupled with the structural elements, respectively, the voltage-applying units applying voltages to the structural elements, each of the structural elements being formed of a piezoelectric material and being expandable and contractable along the static plane and subjected to buckling deformation in response to the voltage applied by the voltage-applying unit so that ink is discharged from each ink-discharge opening, the two end portions of each of the structural elements being secured to the box-shaped body such that each structural element is subjected to buckling deformation when a compressing force within the static plane of the structural element exceeds a buckling load.

16. The ink-jet head as defined in claim 15, wherein the voltage-applying units apply to each of the structural elements a voltage exceeding a buckling load of the structural elements.

17. The ink-jet head as defined in claim 15, wherein the structural elements are made of a single-layer piezoelectric material.

* * * * *